United States Patent [19]

Ferguson

[11] Patent Number: 4,648,749

[45] Date of Patent: Mar. 10, 1987

[54] METHOD AND APPARATUS FOR CONSTRUCTING AN ARTIFICIAL ISLAND

[75] Inventor: Barry W. Ferguson, Delta, Canada

[73] Assignees: Bow Valley Industries Ltd.; Bow Valley Resource Services Ltd.; Canarctic Ventures Ltd., all of Calgary, Canada

[21] Appl. No.: 729,750

[22] Filed: May 2, 1985

Related U.S. Application Data

[63] Continuation-in-part of Ser. No. 423,248, Sep. 24, 1982, abandoned.

[30] Foreign Application Priority Data

Jun. 11, 1982 [CA] Canada ..... 404924

[51] Int. Cl.[4] ..... E02B 17/00

[52] U.S. Cl. ..... 405/205; 405/211; 405/217

[58] Field of Search ..... 405/21, 23, 31, 34, 405/60, 61, 74, 195, 205, 204, 211, 217, 226; 114/77 R; 166/364; 175/9, 45, 61, 66, 206

[56] References Cited

U.S. PATENT DOCUMENTS

| | | | |
|---|---|---|---|
| 1,870,154 | 8/1932 | Wehr | 405/31 |
| 2,217,879 | 10/1940 | Willey | 405/204 X |
| 3,282,355 | 11/1966 | Henderson | 175/61 |
| 3,347,051 | 10/1967 | Bjerke et al. | 114/77 R X |
| 3,393,520 | 7/1968 | Butterworth | 405/21 |
| 3,527,185 | 9/1970 | Yamada et al. | 114/77 R |
| 4,080,798 | 3/1978 | Reusswig et al. | 405/217 |
| 4,134,461 | 1/1979 | Blomsma | 175/9 |
| 4,223,623 | 9/1980 | Brunet | 114/77 R |
| 4,325,656 | 4/1982 | Bishop | 405/217 |
| 4,326,822 | 4/1982 | Oshima et al. | 405/217 |
| 4,397,586 | 8/1983 | Weiss | 405/217 |

FOREIGN PATENT DOCUMENTS

| | | | |
|---|---|---|---|
| 2543320 | 4/1977 | Fed. Rep. of Germany | 405/226 |

*Primary Examiner*—David H. Corbin

*Attorney, Agent, or Firm*—Morgan & Finnegan

[57] ABSTRACT

This invention is directed to a novel method and apparatus for constructing artificial islands in relatively shallow bodies of water such as lakes, seas and oceans for use in drilling oil and gas wells and installing storage and production platforms. The method of building an artificial island in a Water-bound area comprises converting a conventionally designed oil tanker, oil/bulk-/ore, or oil/ore (O, O/B/O, O/O) hull so that it can be partially submerged by liquid or solid ballast; transporting the hull to the water-bound area where the artificial island is to be created; and partially submerging the hull with liquid or solid ballast so that the bottom of the hull is founded on the bottom of the water body, while a portion of the hull remains above the water level. The apparatus capable of forming a temporary or permanent artificial island in a relatively shallow body of water comprises a conventionally designed tanker vessel, and means on the vessel for taking on ballast in the hull thereof to thereby partially submerge the vessel so that it rests on the bottom of the water body while the deck of the hull remains above water.

34 Claims, 30 Drawing Figures

METHOD AND APPARATUS FOR CONSTRUCTING AN ARTIFICIAL ISLAND

This is a continuation-in-part of application Ser. No. 423,248 filed Sept. 24, 1982, now abandoned.

FIELD OF THE INVENTION

This invention is directed to a novel method and apparatus for constructing artificial islands in relatively shallow waters. More particularly, this invention is directed to a novel method and apparatus for constructing artificial islands in relatively shallow bodies of water such as lakes, seas and oceans for use in drilling oil and gas wells and installing storage and production platforms.

BACKGROUND OF THE INVENTION

In recent years, with mankind's increasing and continuous reliance upon hydrocarbon fuels and products, and the depletion of existing oil fields on land in the western hemisphere, extensive and costly efforts have been made to locate petroleum deposits that underly the floors of various large bodies of water such as lakes, seas and oceans. In North America, substantial oil and gas well drilling activity has taken place in the Beaufort Sea, which is in the Arctic Ocean north of Alaska and the northern territories of Canada. Petroleum geologists generally believe that several of the sedimentary geological formations located below the floor of the Beaufort Sea contain large deposits of petroleum material.

Being in a polar region, drilling oil and gas wells in the Beaufort Sea is a hazardous and expensive operation. Ambient temperatures are extremely low during the wintertime. Moreover, tremendous pressures are generated against the drilling station by polar ice. One of the methods used in the Beaufort Sea in preparation for drilling an oil well is to build an artificial island at the location where the well is to be drilled. The material for such islands is dredged from the sea floor and piled in one location until the surface of the island is above the water and ice level. Substantial effort to date has been concentrated in the Canadian sector of the Beaufort Sea where the exploration procedure has followed two main patterns. In relatively shallow water, up to about 19 meters, drilling has been a winter operation from artificial sand islands formed the previous summer by dredging and dumping from barges. In deeper water, from 25 to 68 meters, drilling has been a summer operation using drill ships.

Sand deposited under water tends to take up a very flat edge slope of about 7 to 8 percent with the result that artificial islands in water deeper than about 10 meters consume huge quantities of sand and are hence very expensive to construct. In order to overcome this problem, a caisson-retained island has been developed whereby the upper portion of the sand is retained by a ring or collar of caissons. These are founded on an underwater pad of dredged sand about 10 meters below sea level. Dome Petroleum, a large Canadian company which is actively searching for oil in the Beaufort Sea, completed a concrete caisson-retained island in the fall of 1981. Esso Resources is presently proceeding with the construction of a tensioned steel caisson retained island.

Numerous procedures and apparatus for drilling oil wells in the formations below water bodies have been proposed. Some of these procedures and apparatus are disclosed in the patents listed below:

| Patent No. | Issue Date | Inventor |
|---|---|---|
| U.S. | | |
| 2,472,869 | June 14, 1949 | Travers |
| 2,589,153 | March 11, 1952 | Smith |
| 2,939,290 | June 7, 1960 | Crake |
| 2,973,046 | Feb. 28, 1961 | McLean |
| 4,037,424 | July 26, 1977 | Anders |
| 4,080,798 | March 28, 1978 | Reusswig et al. |
| 4,118,941 | Oct. 10, 1978 | Bruce |
| Cdn. | | |
| 470,212 | Dec. 19, 1950 | Travers |
| 966,320 | April 22, 1975 | Guy |
| 971,758 | July 29, 1975 | Best |
| 1,063,817 | Oct. 9, 1979 | Cashman |
| 1,066,900 | Nov. 27, 1979 | Bennett |

The basic theme of most of these references is to provide artificial islands or operation sites in water bodies such as the Beaufort Sea or the Gulf of Mexico for the purpose of supporting equipment such as drilling rigs engaged in searching for petroleum deposits below the water body floor. Current techniques for building islands cost in the hundreds of millions of dollars and usually consist in part of dredging solid matter from the water body floor and heaping it to thereby provide a foundation of earth material upon which can be situated various types of hardware such as submerged barges or caissons, the tops of which ultimately penetrate the surface of the water body. In some cases, to reduce slump, the sides of the island are supported with a retaining member such as a wall or caisson.

SUMMARY OF THE INVENTION

The present invention is directed to a method and apparatus for constructing an artificial island by taking strengthened conventionally designed tankers, normally capable of transporting oil, bulk material, ore material, or a combination of the foregoing materials, transporting them to the desired sites, either under their own power or by towing and partially submerging the hulls, with earth and water ballast dredged from the sea floor. The hulls can be used individually or in combination. The concept offers the flexibility of providing a movable drilling island, which can be achieved in a relatively short time by partially submerging the hull or hulls, conducting the desired operation such as drilling an oil well, and then when completed, refloating the hull and transporting it to a new site. Alternatively, the partially submerged hull can be left in place to form a production or storage platform. The bow(s) of the substantially submerged hull(s) would normally be pointed in the direction of the prevailing winds, waves and ice action for the area.

The invention is directed to a method of building an artifical island in a water-bound area comprising converting a conventionally designed tanker so that it can be partially submerged by liquid and/or solid ballast; transporting the hull to the water-bound area where the artificial island is to be created; and partially submerging the hull with liquid or solid ballast so that the bottom of the hull is founded on the bottom of the water body, while a portion of the hull remains above the water level.

The method may include drilling an oil well into the floor of the water body while the partially submerged hull is founded on the bottom of the water body. The hull may be refloated after being partially submerged by removing ballast from the interior of the partially submerged hull.

If the oil well experiences a blow out during the drilling thereof, the crude oil is directed into the interior of the partially submerged hull to prevent contamination of the water body. The oil direction can be automatic or by pump. A relief well may be drilled from the partially submerged hull while the oil well is experiencing a blow out. The stored oil can be burnt off or hauled away.

In the method, a protective barrier may be constructed alongside at least one side of the partially submerged hull by dredging solid material from the water body floor and heaping it along side the partially submerged hull. The artificial island may be formed by two partially submerged ship hulls. The two partially submerged hulls may be arranged side by side in parallel adjacent manner.

A protective barrier may be constructed alongside at least one side of the partially submerged hull by dredging solid material from the water body floor and heaping it along side the partially submerged hull which is arranged in a V-pattern with another partially submerged hull. The protective barrier constructed along side at least one side of the partially submerged hull may be formed by dredging solid and liquid material from the water body floor and freezing the dredged material, before depositing the frozen material on the water body floor alongside the partially submerged hull.

A protective barrier may be constructed along side at least one side of the partially submerged hull by dredging solid and liquid material from the water body floor, depositing the dredged material on the surface of ice surrounding the partially submerged hull thereby sinking the ice and the dredged material onto the water body floor. The dredged material is allowed to freeze prior to submerging.

Barrier protection for the partially submerged hull may also be created by partially submerging at least one ship hull so that it projects radially from the main partially submerged hull. A plurality of ship hulls in a radially disposed pattern may be placed around the circumference of the main partially submerged hull. This is useful when the main hull is left in place as a production or storage platform.

The invention is also directed to an apparatus capable of forming a temporary or permanent artificial island in a relatively shallow body of water which comprises a conventional type tanker, and means on the tanker for taking on ballast in the hull thereof to thereby partially submerge the vessel so that it rests on the bottom of the water body while the deck of the hull remains above water.

The vessel may include means for ejecting ballast from the interior of the hull to thereby refloat the partially submerged vessel. The vessel may be self-propelling. The vessel may have an oil well drilling rig mounted on the deck of the hull. The vessel may also have a moonpool (an oil retaining cavity) built into part of the interior of the hull below the drilling rig. The hull of the vessel may be mounted on top of a second ship hull to provide a double-decker hull. The vessel may have two oil well drilling rigs mounted on the deck of the hull and two moonpools built into the interior of the hull, one below each drilling rig. Normally, the second moonpool would be at a reasonable distance from the first moonpool.

In zones where the water body floor is mainly clay-like in character, refloating may become a problem due to suction created at the bottom of the vessel. In order to overcome this suction action, it might be desirable to install a number of pipes in the bottom of the hull for injecting air or water at suitable pressure thereby relieving the suction force. In certain situations, to withstand extreme lateral forces by increasing the overall specific gravity of the submerged vessel, it may be necessary to use iron ore pellets as ballast instead of sand or the like.

To withstand ice pressures, and the like, the hull can be strengthened by using heavy steel cross-struts, inter-rib reinforcing. Alternatively, or in accompaniment, the spaces between the frame members of the hull can be filled with concrete and steel reinforcement. The rudder and propeller of the vessel can be protected within a housing formed in the vessel body so that the propeller and rudder can be used repeatedly as the vessel is submerged for a time, refloated and moved to a new site and then submerged again prior to drilling at the new site.

To prevent freezing of ballast water, such freezing being capable of damaging the hull body, by expansionary ice forces, insulation to reduce heat loss from the interior of the hull can be installed, or the ballast water can be heated by some suitable economical means. The vessel can be equipped with its own dredging, sand and water pumping equipment so that it is self reliant.

DRAWINGS

Figure 11:
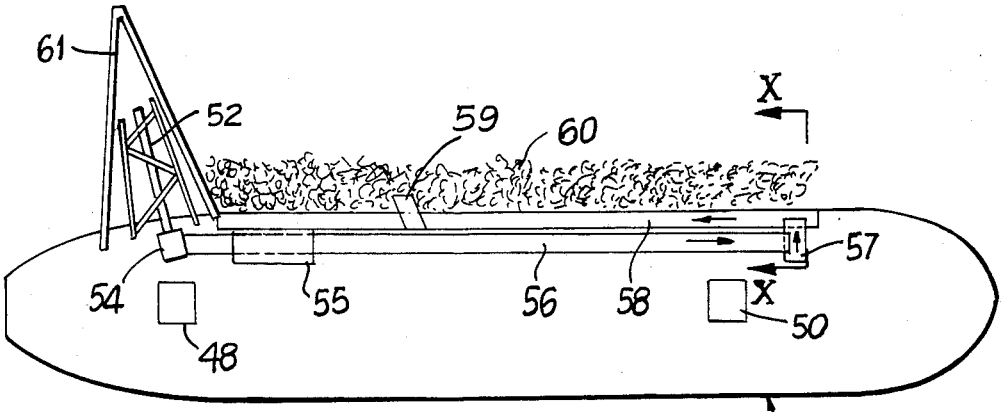
FIG. 11 represents a plan view of a hull converted according to the invention, together with a dual direction conveyor belt arrangement which can be utilized for manufacturing protective ice-earth debris and dumping it along side the hull to provide a submerged protective barrier for the hull.
Figure 11A:
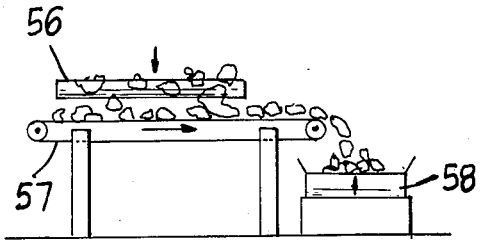

FIG. 11*a* is a sectional elevational view taken along line X—X of FIG. 11.

Figure 12:
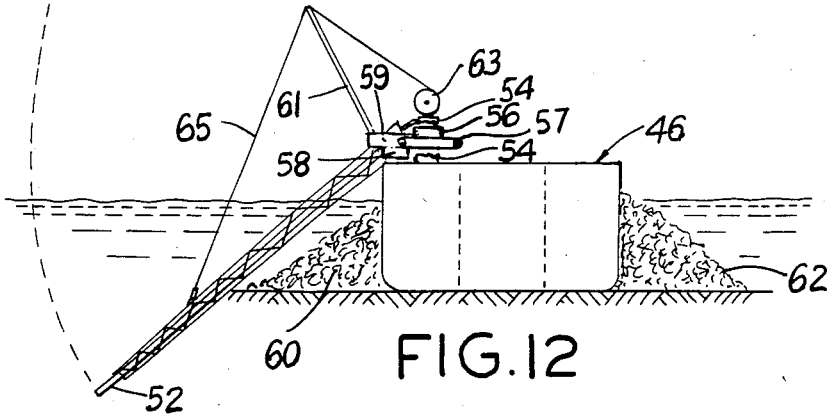
Figure 13:
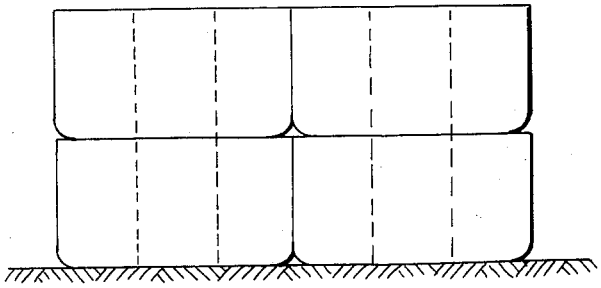
Figure 14:
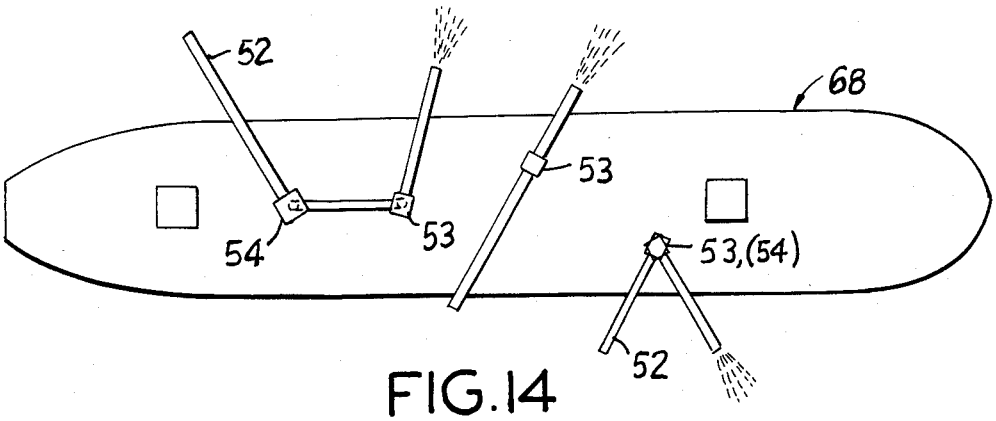
Figure 15B:
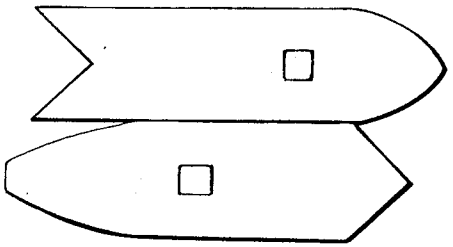
Figure 15A:
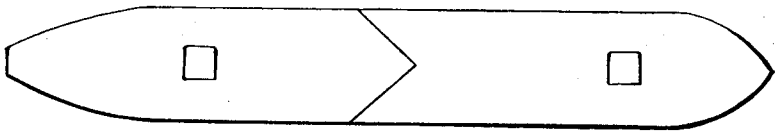

FIG. 12 represents a rear elevation view of the ship hull depicted in FIG. 11 above, illustrating the manner in which debris is placed on either side of the hull to provide a protection barrier for the hull;

FIG. 13 represents an end elevation view of a pair of converted double decker hulls placed in parallel adjacent alignment with one another;

FIG. 14 represents a plan elevation view of a hull equipped with bottom debris pumping and spraying equipment for use in spraying sand, soil and water onto the ice perimeter surrounding the hull;

FIGS. 15*a* and 15*b* represent plan elevation views of a converted hull which may be detached or separated in the mid region as illustrated in FIG. 15*a* to provide an artificial drilling island comprising the two detached portions of the hull arranged in parallel adjacent position as shown in FIG. 15*b;*

Figure 16:
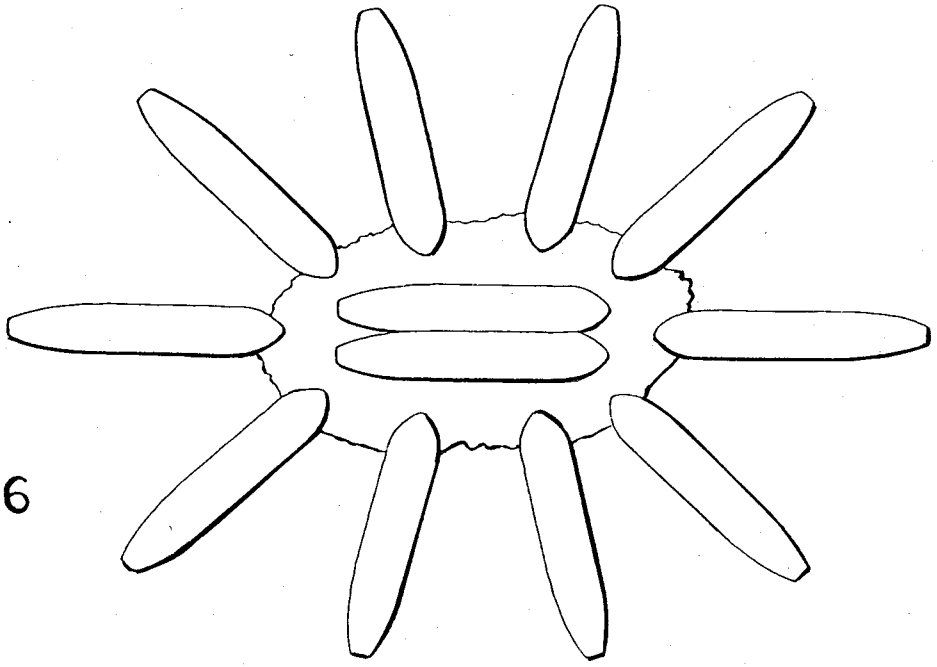
Figure 17:
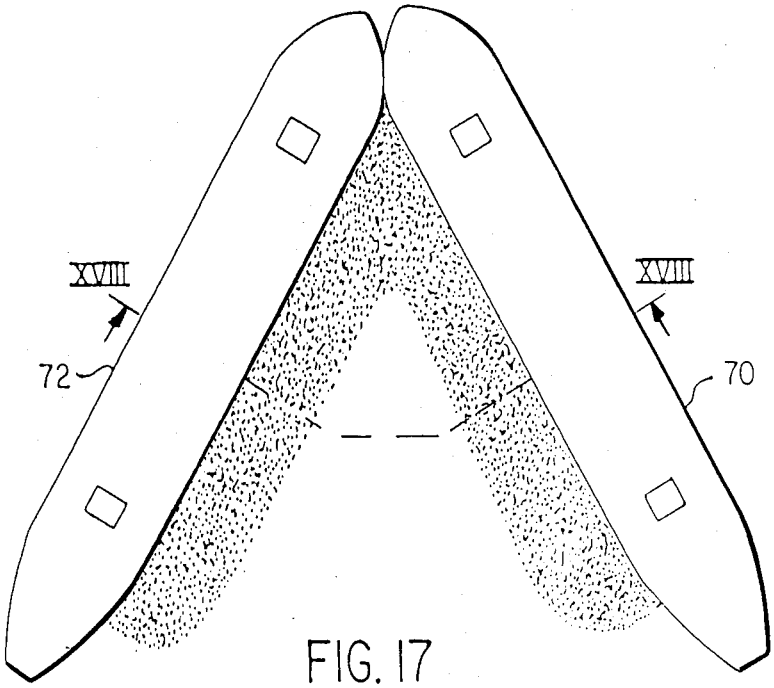
Figure 18:
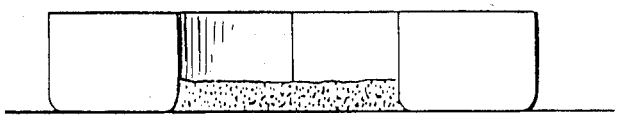

FIG. 16 represents a plan elevation view of two adjacent aligned converted hulls, surrounded by reinforcing barrier debris, and a plurality of radially disposed tanker hulls around the perimeter of the barrier;

FIG. 17 represents a plan elevation view of two converted hulls arranged to provide a wedge arrangement for withstanding ice and wave forces;

FIG. 18 represents a sectional view taken along line XVIII—XVIII of FIG. 17.

Figure 19:
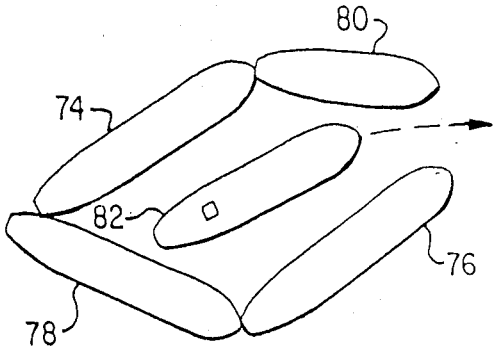
Figure 20:
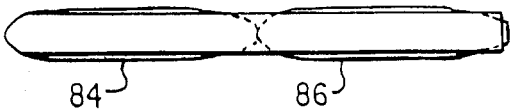

FIG. 19 represents a plan view of the manner in which four converted hulls can be utilized to provide a protective ship harbour;

FIG. 20 represents a plan view of the manner in which two converted hulls can be arranged in end to end relationship to provide an aircraft landing strip.

Figure 21:
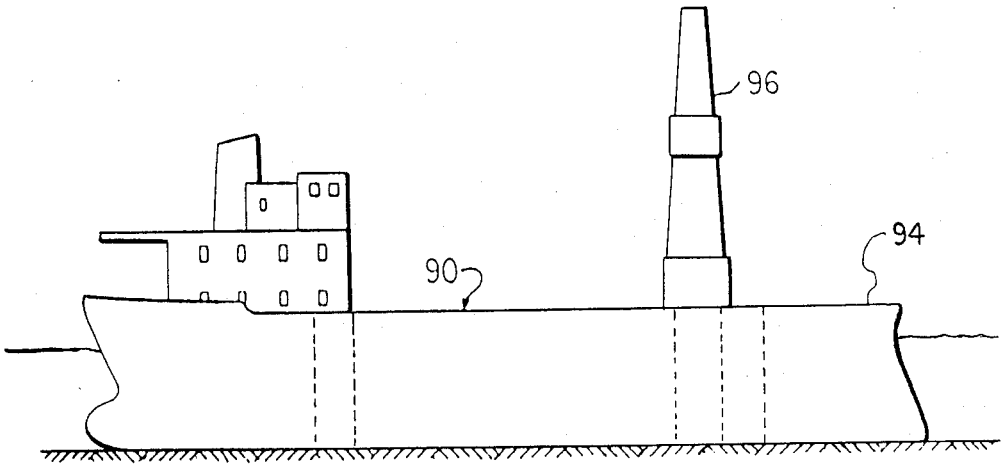
Figure 22:
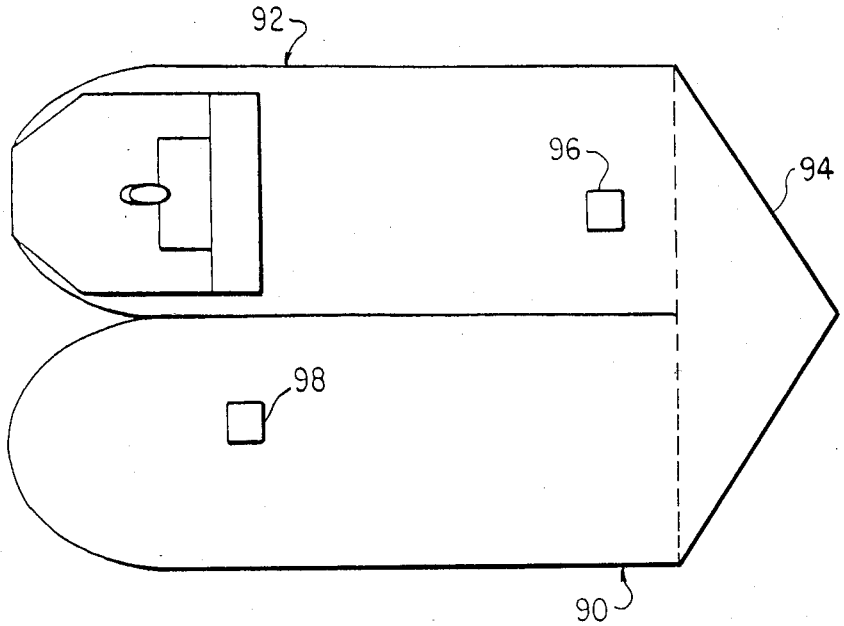
Figure 23:
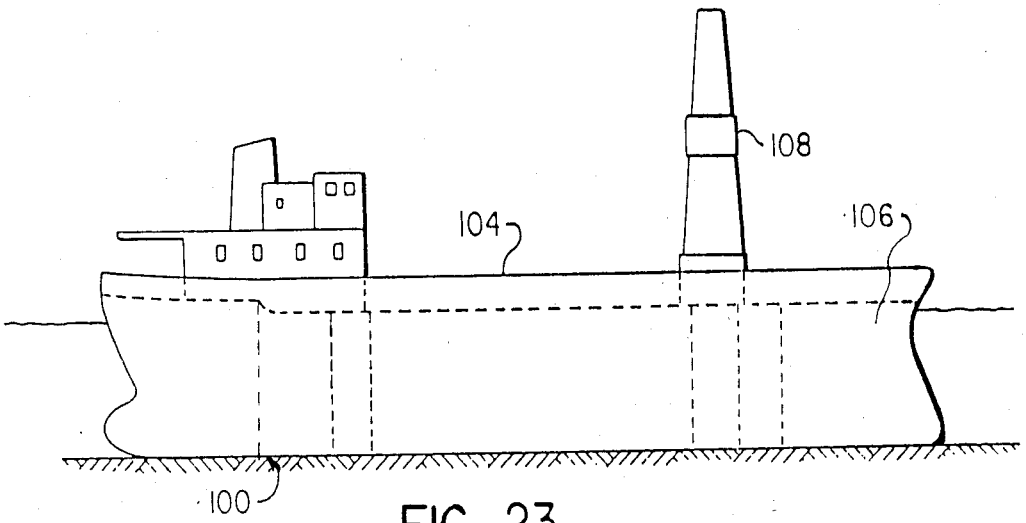
Figure 24:
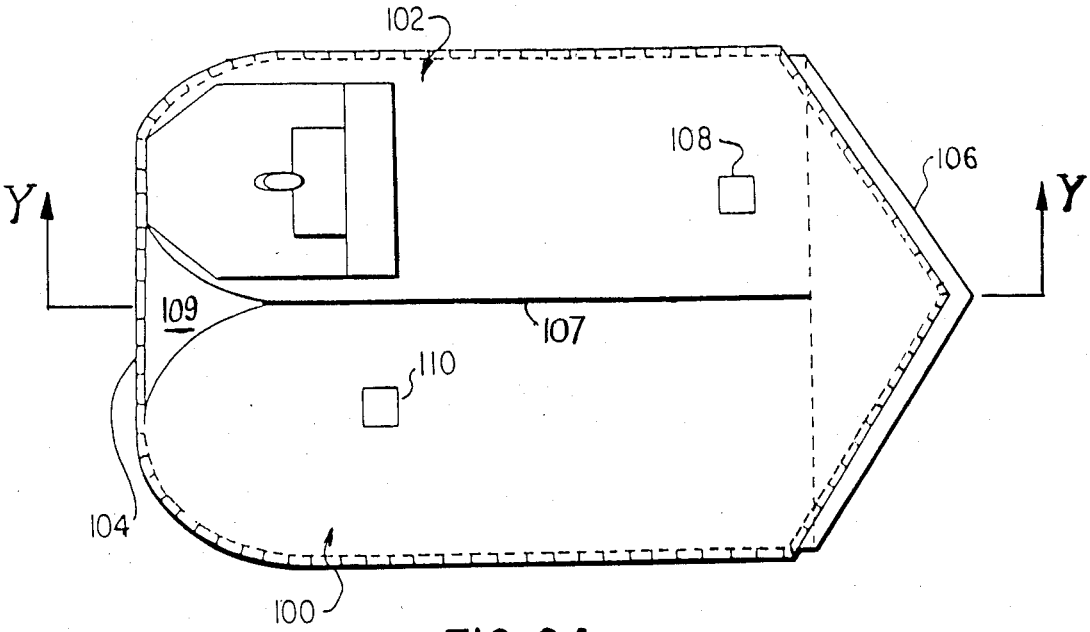
Figure 24A:
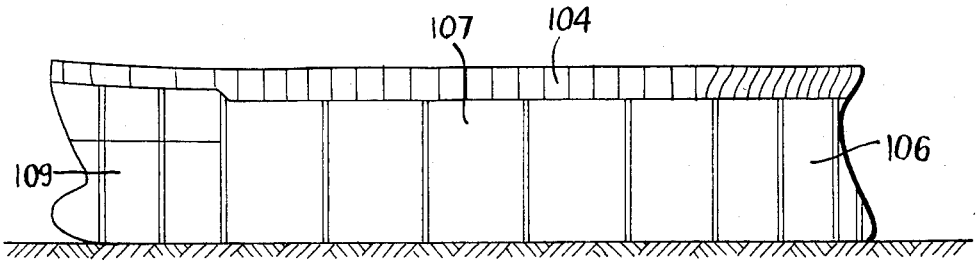
Figure 24B:
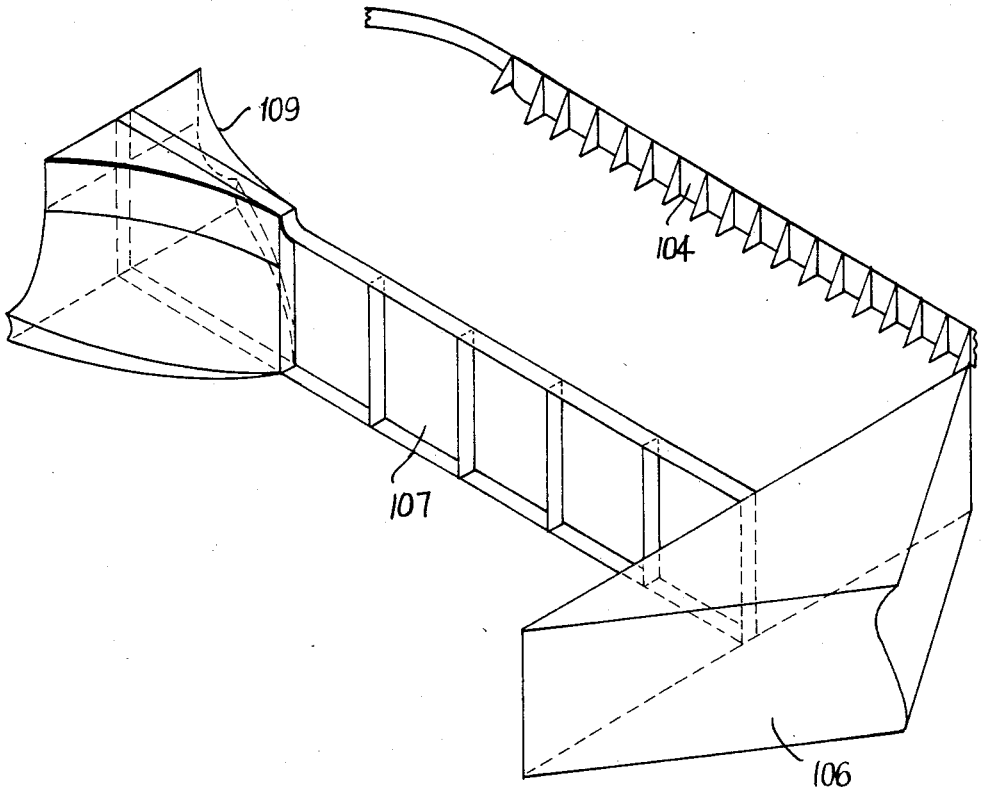
Figure 25:
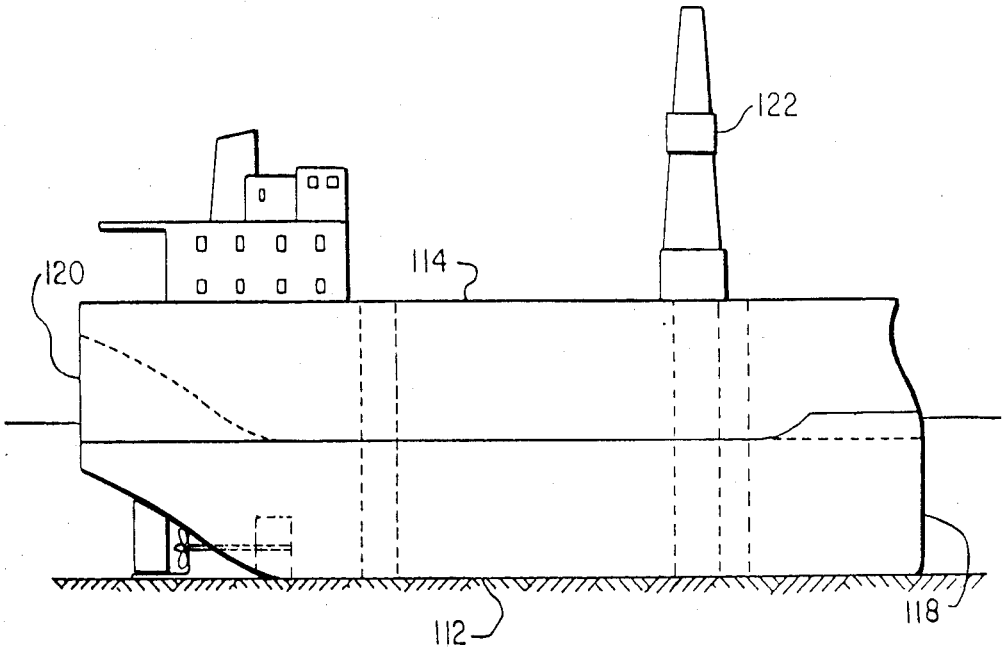
Figure 26:
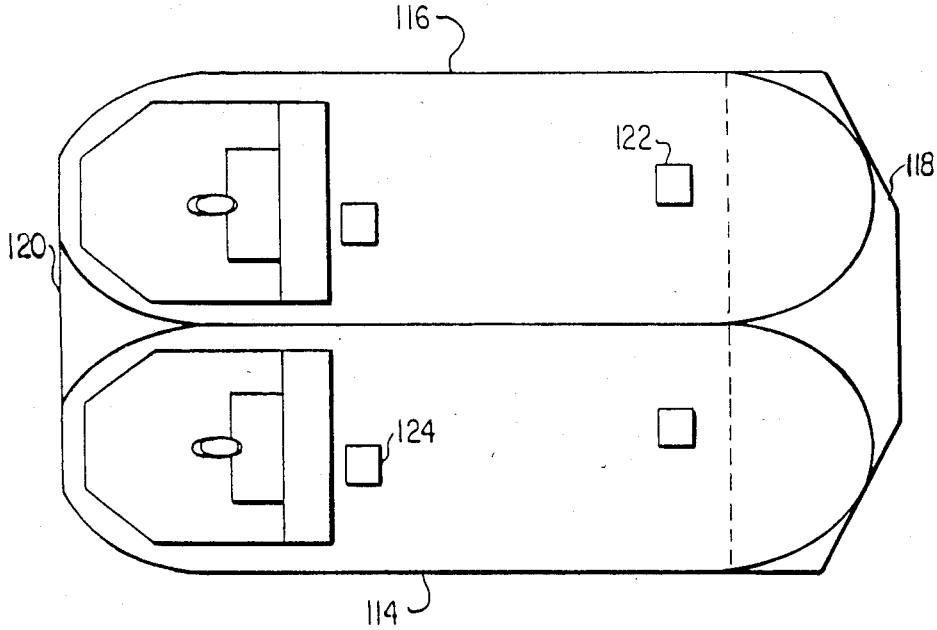

FIG. 21 represents a side elevation view of a twin hull design fitted with a new bow section;

FIG. 22 represents a plan elevation view of the twin hull design fitted with a new bow section;

FIG. 23 represents a side elevation view of a twin hull design fitted with new bow and stern sections, a center connecting piece, and a gunwale height extension;

FIG. 24 represents a plan elevation view of the twin hull design shown in FIG. 23;

FIG. 24*a* is a sectional view taken along line Y—Y of FIG. 24;

FIG. 24*b* is a perspective view of the bow and stern sections, center connecting piece, and gunwale height extension shown in FIG. 24;

FIG. 25 represents a side elevation view of a double decker, twin hull combination design, with the lower twin hulls fitted with a new bow section; and, FIG. 26 represents a plan elevation view of a double-decker, twin hull combination design, with the lower twin hulls fitted with a new bow section.

DETAILED DESCRIPTION OF THE INVENTION

Figure 1:
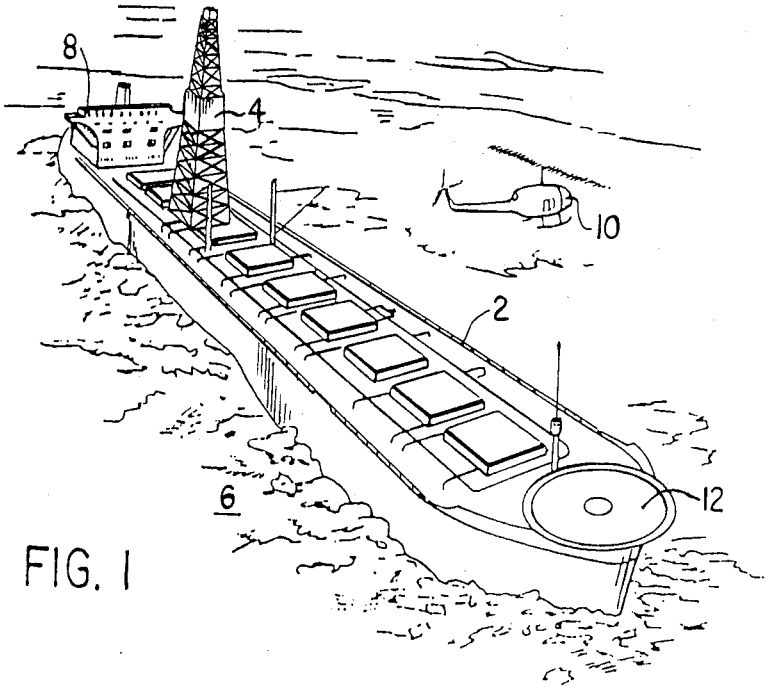
FIG. 1 represents a perspective view of a tanker of conventional design converted for use as an artificial island and drilling platform.

Referring to FIG. 1, a ship hull 2, according to one aspect of the invention, is equipped with and carries a drill rig 4. The hull is shown located in a large body of ice 6. While not shown, the bottom of the hull 2 rests on the bottom of the body of water supporting the ice 6. The drill rig 4 is positioned towards the stern of the hull 2 ahead of the wheel house 8. The bow of the hull carries a helioport 12 which serves as a landing pad for a helicopter 10. The helicopter 10 serves to provide supplies for operation of the hull-drill rig assembly. The hull 2 is suitable for operation in waters of about 20 meters depth. This leaves about 5 meters of freeboard.

Figure 2:
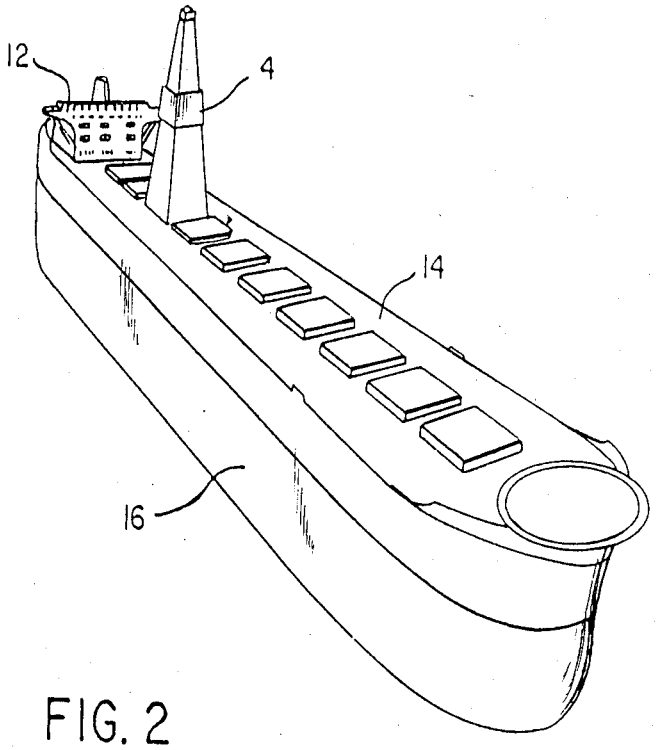
FIG. 2 represents a perspective view of two hulls, one above the other, converted for use as an artificial island and drilling platform.

FIG. 2 illustrates the manner in which, according to another aspect of the invention, one hull 14 is positioned above and secured to a second hull 16 in double decker manner. This double decker hull combination enables the hull rig combination to operate in deeper waters than the single hull version, for example, waters of about 45 meters depth.

The double decker hull arrangement as shown in FIG. 2 can be manufactured in a number of ways. One possible way is to clean away the normal deck equipment on a hull, sink the hull with suitable ballast, move a second floating hull into position over the submerged hull, and then secure the two hulls together by suitable bracing such as steel beams, welding and the like. Wedges must be inserted in the tapered spaces that normally exist between the deck of the underlying hull and the bottom of the super-imposed hull to offset the lateral camber customarily built into the deck of the underlying hull.

Normally, in Arctic waters, such as the Beaufort Sea, either the single hull or double decker hull design, when founded upon the floor of the waterbody, should be oriented with its bow facing to the northwest into the direction of prevailing winds, waves and ice migration prevalent in those areas. Even so, in some locations, a wave deflector may be required to increase freeboard and limit the volume of water taken on deck from maximum broadside waves.

Figure 3:
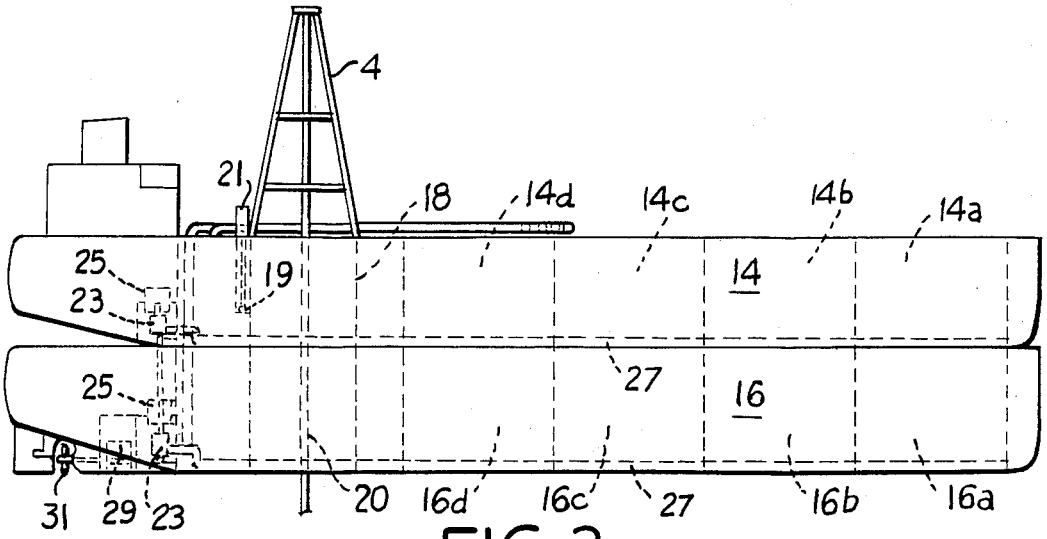
FIG. 3 represents a side elevation view of the double decker hull with a drilling rig erected in place over a moonpool in the hull.

FIG. 3 represents a side elevation view of the double decker hull design depicted in FIG. 2. The upper hull 14 is secured to the lower hull 16 by welding, cables, steel reinforcement, and the like. As can be seen in FIG. 3, the drill rig 4 is positioned above a moonpool 18 which extends vertically from the deck of the upper hull 14 through the two hulls, to the bottom of the lower hull 16. The moonpool 18 is an enclosed cavity open to the atmosphere with overflow drains 19 into the hull or hull compartments. As can be seen in FIG. 3, the drill rig 4, by being positioned above the moonpool 18, can raise and lower drill stem 20 through the moonpool 18 into the seabed below the bottom of hull 16 for drilling in the manner of a conventional oil well. Also shown in FIG. 3 are the many compartments in the upper hull 14 and the lower hull 16, and each hull is equipped with pumps 23 for taking on or ejecting ballast through the ballast intake 25, into or from the compartments by means of the piping 27. FIG. 3 also shows the engine 29 and the propeller 31 as a means to move the double decker hull from one location to another.

A very significant advantage of the moonpool 18 design is that if there is a blowout of the well being drilled, the crude oil that is blown out can be initially contained within the confines of the moonpool 18 and then directed into the hull or compartments by the overflow drain 19 thereby completely preventing pollution in the delicate environment of the Arctic. If the blowout is extensive and long lasting, the escaping crude can be directed automatically or pumped by pump 21 into the sizeable compartments in the upper hull 14 (14*a* to 14*d*) and the lower hull 16 (16*a* to 16*d*). The capacity of these two hulls, even if partially taken up with ballast, is significant and can in most cases contain four to six months "wild" production from the well.

Figure 4:
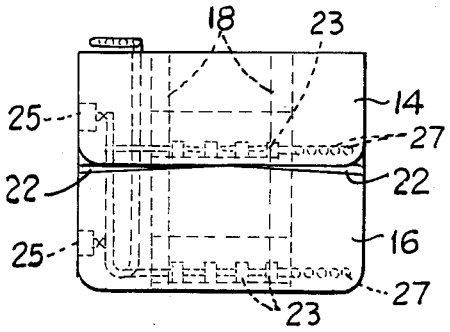
FIG. 4 represents an end elevation view of the double decker hull.

FIG. 4 shows an end elevation view of the double decker hull design including the upper hull 14, the lower hull 16, the moonpool 18, the ballast valved intakes 25, the pumps 23 and the piping 27 as a means to transfer oil or ballast to or from the hull compartments, 14 and 16. FIG. 4 also illustrates the wedges 22 which are welded or secured in place between the upper and lower hulls in order to offset the camber of the deck of the lower hull 16 and provide a stable secure fit between the upper hull 14 and the lower hull 16.

Figure 5:
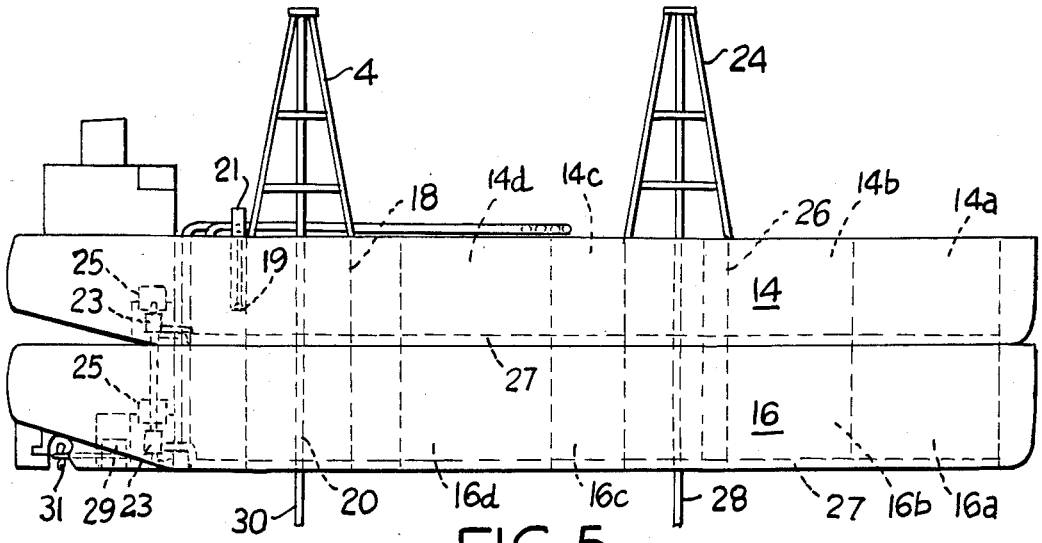
FIG. 5 represents a side elevation view of the double decker hull supporting two drilling rigs, one rig for drilling the primary oil well and a second rig for drilling a second oil well or a relief well.

As FIG. 5 demonstrates, the double decker hull design can be fitted with two drilling rigs 4 and 24. In such a case, the ship is also fitted with two moonpools 18 and 26 respectively. The second rig 24 can be used for drilling a relief hole to intersect with the main hole being drilled by rig 4 if for some reason, such as a blowout or a collapsing formation, it is necessary to interconnect with the first hole. The auxiliary rig 24, rather than acting as a relief measure, can be used to drill a second hole at the same time that the first hole is being drilled. The direction of the two holes can be diverged by means of directional drill bits. This tandem arrangement can be important in controlling the areas where the drilling season is short.

Figure 6:
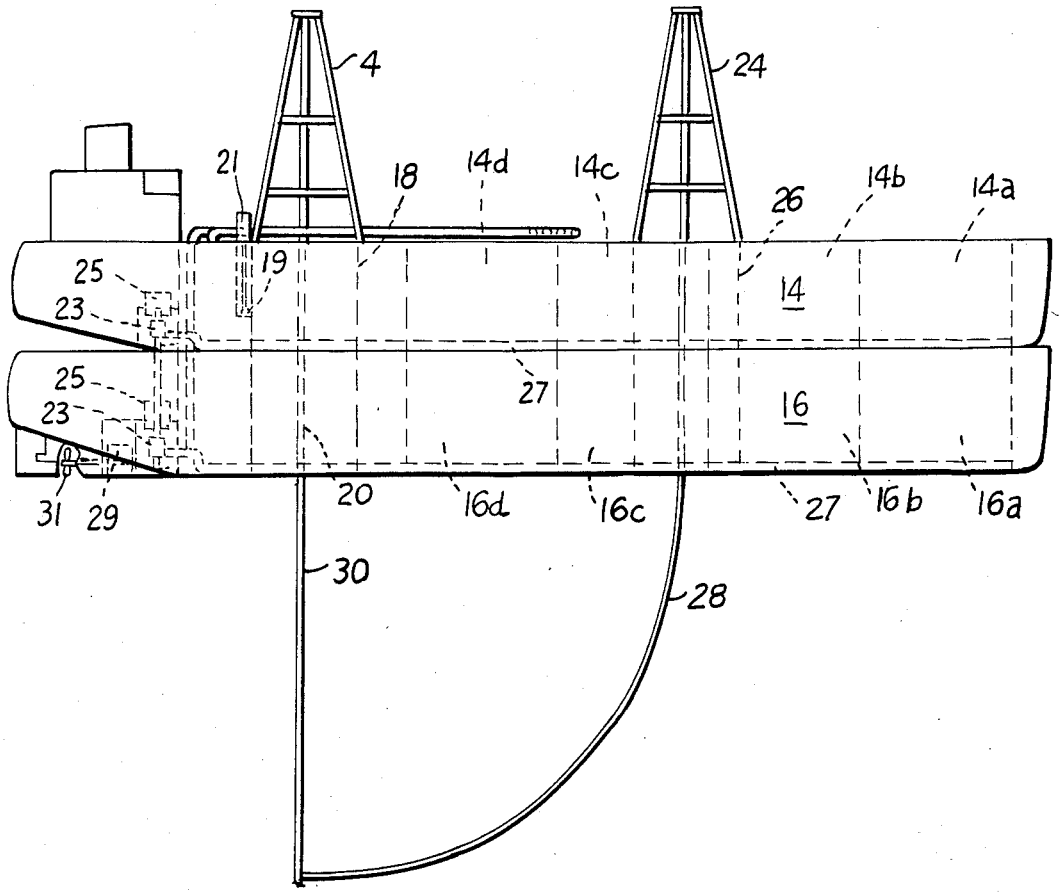
FIG. 6 represents a side elevation view of the two rig double-decker hull combination depicted in FIG. 5 above, illustrating the manner in which a relief hole is drilled to intersect with the main drilling hole.

FIG. 6 illustrates in side elevation view the manner in which a relief hole 28 can intersect with main hole 30 utilizing the dual rig arrangement, rig 4 and 24, discussed above.

Figure 7:
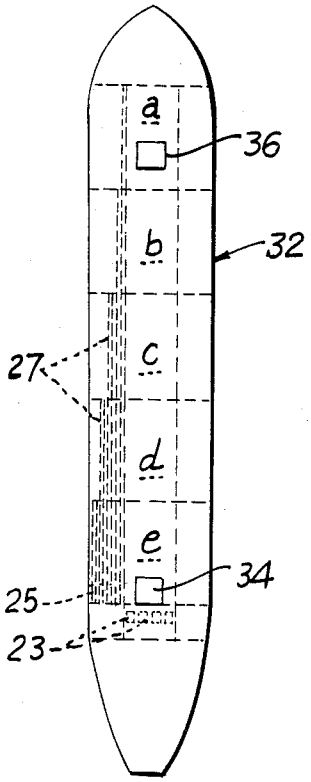
FIG. 7 represents a plan view of a converted hull equipped with two "moonpools" for dual rig drilling capability.

FIG. 7 illustrates in plan view a typical single hull 32 with two moonpools 34 and 36 and the multiplicity of compartments a, b, c, d and e, with port, center and starboard subcompartment indicated within the hulls, with the necessary piping 27, pumps 23 and ballast valved intakes 25 to transfer oil or sea water. As well shown in this figure, the hull is part of a conventionally designed tanker comprising bow and stern portions which are longitudinally tapered with respect to a central vertical plane of the hull.

Figure 8:
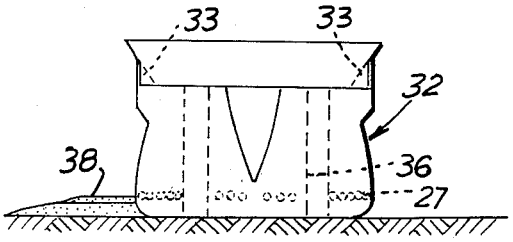
FIG. 8 represents an end elevation view of the hull depicted in FIG. 7 above resting on the sea floor.

FIG. 8 illustrates in end elevational view the manner in which a berm 38 may be built up on one side of hull 2. Alternatively, the berm 38 allows reduced ballasted weight on relatively weak soils where the depth of such soils make it impracticable to remove them. As seen in FIG. 8, the sides of the hull can be slanted inwardly in an upwardly direction to thereby tend to reduce the lateral forces of the ice pack by deflecting them upwardly. Wave deflectors 33 can also be mounted on the gunwales of the hull to deflect ice and water from the deck in strong adverse conditions.

Figure 9:
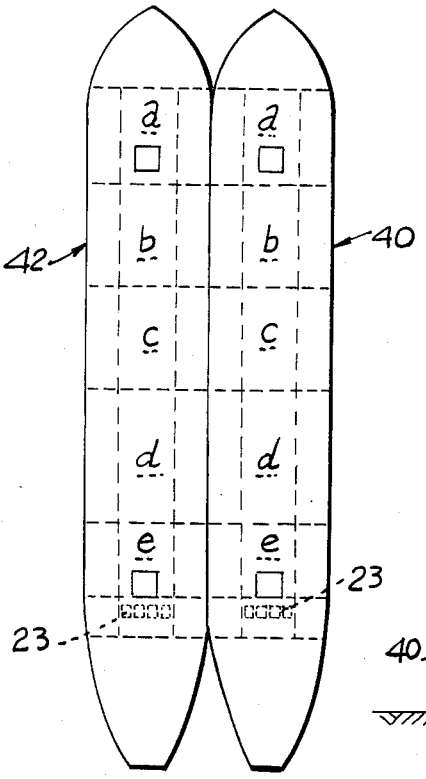
FIG. 9 represents a plan view of two converted hulls placed in parallel aligned position.
Figure 10:
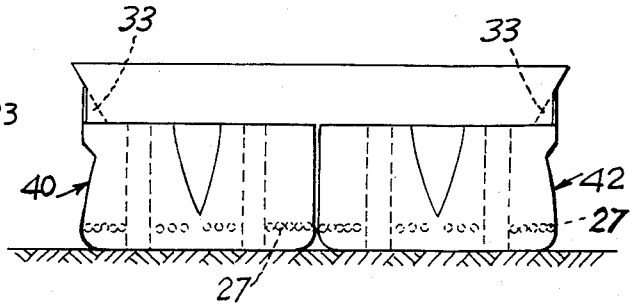
FIG. 10 represents an end elevation view of the twin hulls depicted in FIG. 9 above.

FIG. 9 depicts in plan elevation view a twin-hull alignment that can be utilized where the sea bed soil is weak or where the predicted ice or wave forces may be greater than can reasonably be endured by a single hull. The parallel arrangement of the twin ships 40 and 42 immediately doubles the lateral resistance for the same effective ballasted weight. Alternatively, this twin-hull arrangement can allow a reduced ballasted weight on relatively weak soils of low stability where the extensive depth of such soils makes it impractical to remove them. FIG. 10 demonstrates in end elevation view the twin hull concept 40 and 42, and the manner in which the two hulls are founded on the sea-bed.

FIG. 11 illustrates a system which can be used for manufacturing solid debris for distributing along the sea floor to build up a protective barrier 60 along the sides of the vessel 46. The vessel shown has two moonpools 48 and 50. The system consists of a hydraulic suction line 52 which has one end resting on the sea floor. The line 52, by means of suction exerted by mud and sand pump 54, or the like, draws up clay, sand, sea water, and other solid material from the sea bottom and deposits it on a long moving chilling conveyor 56 which extends substantially the length of the vessel 46. The solid-water mixture deposited on the conveyor 56, when ambient temperatures are well below freezing such as in the Arctic during the winter, freezes into a solid mass as it is conveyed along the conveyor 56. When the ambient temperature is not cool enough, a refrigeration system in a belt chilling arrangement 55 freezes the mixture. At the end of the conveyor 56, away from pump 54, the solid material breaks off of the conveyor and is deposited onto a second or transverse conveyor 57 which in turn deposits the solid material on the adjacent third conveyor 58 that runs in a direction parallel with and opposite to conveyor 56. Conveyor 56 is normally located at the edge of the hull of the vessel 46. By means of a mechanical arm 59, or manual power, or the like, the frozen solid debris travelling along conveyor 58 can be pushed over the side of the vessel so as to sink to the bottom of the water body. FIG. 11*a* is a sectional elevation view showing the relationship of the conveyors 56, 57 and 58. In this way, a barrier of solid material, which should remain in frozen condition for a significant length of time, can be built up alongside the submerged hull of the vessel 46. This provides valuable protection for the hull 46 against lateral pressures exerted by waves and ice. The system described can be utilized for depositing a similar barrier along the opposite side of the hull 46. To slow down thawing of the frozen debris once it has been deposited in the sea water, cedar bark or other cheap, available coarse material with insulating qualities can be incorporated in the debris while it is being frozen. Such material can be carried in the vessel's hold initially or be brought to the site in a supply ship or the like.

FIG. 12 depicts in an end elevation view the method and equipment whereby water, sand and clay are sucked off the sea bottom and through the hydraulic suction line 52 by the pump 54 and are then deposited on the chiller conveyor belt 56 to create frozen material so that the debris 60 and 62 can be built up along each side of the vessel 46. By means of the gin pole 61, the wire line 65 and the winch 63, the hydraulic suction line is controlled and moved to various locations on the sea floor. FIG. 13 represents in end elevation view a combination of vessel hulls which can be achieved by combining the twin-hull concept of FIG. 9 with the double decker hull concept of FIG. 4. This combination can be utilized in areas where the water depth is in the range 20 to 45 meters and excessive ice and wave action pressures are encountered, thereby requiring extra stability.

FIG. 14 in plan elevation view illustrates a system whereby water pumps 53 in combination with hydraulic suction lines 52 and suction pumps 54, which draw solid and liquid material from the seabed, can be utilized for pumping and spraying water, sand, silt and other bottom material onto the ice surface surrounding the vessel 68. The bottom material is allowed to freeze to be contiguous with the ice. Eventually, with build-up, the heavy weight of the solid material pumped onto the ice around the perimeter of the vessel 68 will submerge the ice whereupon everything will sink to the sea bottom. In this way, with repeated build-up of ice, and depositing of sand and debris onto the surface of such follow-up ice, an effective ice-solid barrier wall can be built up around the perimeter of the vessel 68.

FIG. 15*a* shows in plan elevation manner a split hull design which can be separated or detached where indicated at its mid-region and the two separate hulls placed alongside one another in parallel manner as shown in FIG. 15*b* to provide a twin hull configuration similar to that illustrated above in FIG. 9.

FIG. 16 illustrates in plan elevation view a system that can be used for reinforcing an artificial island created by a twin-hull combination, and a barrier reef built up around the periphery of the twin hulls, to withstand for a long period of time extremely severe ice and wave forces emanating from any direction. A number of hulls, ten are shown, ballasted so that they sink to and rest on the sea floor, are arranged in radial pattern around the circumference of the twin hull surrounding barrier island combination. The ballasted hulls that are arranged radially should have their noses (the ends of the hulls remote from the twin hull-barrier combination) cut down, sloped downwardly, or submerged below the ice level on the water, so that any ice that may contact the noses of those hulls will tend to ride up on the hulls, and translate the forces downwardly. This is preferable to having the ice meet the noses head-on and thereby impart the forces through the hulls directly onto the peripheral barrier protecting the twin hulls. Preferably, the radially disposed partially submerged hulls are initially ballasted with large objects such as rocks and the like and transported partially submerged to the site. Rocks are preferred so that if any holes are punched in the hulls by ice, the ballast will not flow out through the holes onto the sea floor, thereby losing effectiveness as ballast. When no longer of use, the holes can be sealed, the hull refloated and transported.

FIG. 17 illustrates a variation of the twin hull concept illustrated in FIG. 9 whereby two hulls 70 and 72 are arranged in a V-pattern (inverted in FIG. 17). The point of the V faces the direction of prevailing wind, ice and waves. The space between the arms of the V are filled with sand, solid debris and the like in order to prevent the two V-arranged hulls from being forced to move under the pressure from ice and waves. FIG. 18 illustrates in a sectional view the manner in which the V-arranged hulls are founded on the sea floor.

FIG. 19 illustrates in plan elevation view an arrangement of three hulls, together with a shorter ship hull, to provide a protected harbour area for a supply ship or a production transportation ship for a well which has been drilled in hostile waters such as the Arctic Ocean. Three of the vessels 74, 76 and 78, are arranged so that their respective bows or sterns intersect to provide a generally "U-shaped" configuration. The open end of the "U" is partially closed by means of a vessel of shorter length 80. The supply ship 82 can enter and leave the protected area formed by the linked vessel arrangement through the opening existing between vessels 76 and 80.

FIG. 20 illustrates the manner in which two vessels 84 and 86 may be arranged in end to end alignment so as to form a long surface which can be converted into a runway for aircraft. Normally, two vessels arranged in this manner should be of sufficient length to provide a landing and takeoff area for transport aircraft such as Hercules or Caribou aircraft.

FIGS. 21 and 22 illustrate an embodiment of the invention wherein a pair of separated hull sections 90 and 92 are arranged side-by-side, in parallel alignment, in twin-hull pattern, the combination being fitted with a new bow section 94. A rig 96 is mounted at the fore of hull 92, and optionally a relief rig 98 can be positioned at the aft section of hull 90.

FIGS. 23 and 24 illustrate a further embodiment of the invention wherein two separated hull sections 100 and 102 are arranged in twin-hull pattern, by means of the center connection piece 107 with the combination being fitted with a gunwale height extension 104, a new bow section 106 and a new stern section 109. The center connection piece is secured between and to the hull section as by welding for instance to secure the hull sections with respect to each other, and the new bow, stern and gunwale height extension are likewise suitably secured in place as by welding. FIG. 24*a* and 24*b* are views that show the detail of the new components. A rig 108 is mounted at the fore of hull 102 and optionally a relief rig 110 can be positioned at the aft section of hull 100.

FIGS. 25 and 26 illustrate a further embodiment of the invention wherein two separated hull sections (one section is identified as 112 while the second cannot be seen in either FIGS. 25 and 26) are arranged in twin-hull pattern while a second pair of sections 114 and 116 are superimposed in double-decker twin-hull pattern upon the underlying twin hulls 112 and the unseen hull. A new bow section 118 is fitted at the front of the lower twin hulls. A new stern section 120 is fitted at the rear of the upper twin hulls 114 and 116. Drilling rig 122 and optional relief rig 124 are mounted on the upper twin decks. This configuration provides double height and double lateral stability.

The predominant force is from ice and the maximum lateral force on the vessel founded within the land fast ice, including wind and current forces, may amount to as much as 118,000 tonnes. The effective submerged weight to resist lateral movement will depend upon sea-bed conditions but is likely to average about 236,000 tonnes for the single ship hull concept.

While a bottom sea depth of about 20 meters is feasible for the single converted hull configuration, if drilling is to be conducted in waters deeper than about 20 meters, then in place of the double-decker hull design, if required, a sand-base or rock-base island can be built up to within a depth of 20 meters below the high water mark and the single hull design founded on that island.

The single or double decker hull concept provides a relatively inexpensive movable drilling island which, in the short time available in Arctic regions, can be advantageously moved by towing or self-propulsion to a prospective drilling site, sunk so that it rests on the sea floor by use of permanent and temporary ballast, and then after a well is drilled (typically 90–180 days), be refloated and moved to a new drilling site. In this way, the single or double-decker hull concept provides the possibility of drilling two oil well holes per year in different locations, one typically in the winter, the second typically in the summer. In an average year, with some ice breaker assistance, it should be possible to refloat and transfer the rig-vessel to a new location in the short open water season of each year. During periods when the seas are generally calm, the sinking of the hull to the sea bed will be a relatively easy operation. When waters are rough and lateral forces from ice pressure prevail, sinking the hull to rest on the sea bottom will require more bottom preparation and care.

The depth to which a vessel may be sunk as a grounded drilling island will depend on the freeboard required in relation to the extreme peak wave heights on the bow and sides of the hull. Considerable water and spray may be accepted over the deck surface and drained away through scuppers during extreme wave action. Alternatively, wave and spray deflectors can be built along the sides of the hull to increase the effect of freeboard. Ideally, temporary ballast used to submerge the hull should be in the form of sea water so that it can be easily pumped out prior to moving to a new site. However, sand and other heavier material will sometimes be used for temporary ballast in order to provide increased stability to the hull when founded on the sea bottom. To refloat the hull, the sea water used as ballast may by pumped out. If sand ballast is used, it may be necessary to remove some or all of the sand by some suitable means before sufficient buoyancy of the hull can be achieved to refloat the vessel. A complicating factor in areas where the sea bottom is mostly clay is the possibility of strong suction forces being exerted on the bottom of the hull. To overcome this, it may be desirable to install a number of small pipes to the bottom of the hull (preferably outside the hull) for injecting air or water at suitable pressure into the interface between the clay bottom and the keel of the hull. Alternatively, a sand bed can be put down prior to founding the hull on the bottom to prevent suction problems.

To withstand the substantial external ice and wave forces, the hull must typically be strengthened. One method may involve adding additional vertical steel members between the main frames to withstand the ice forces over the range of height in which they would act. A second alternative may be to fill between the main frames with concrete and additional steel reinforcement as required.

To protect the propeller and rudder of the vessel from ice damage, and the like, the propeller area of the vessel should be protected. This ma include protecting the propeller by a suitable housing that is sufficiently strong to withstand the substantial ice pressures that might be exerted.

To prevent damage to the interior of the hull that might occur due to freezing of ballast water and the like within the hull at portions of the hull that remain above the water level, insulation to reduce heat loss or ballast heating water means may be used.

Waves acting on the ship will cause scour erosion to the water body floor supporting the vessel and suitable scour protection should be used. However, in Arctic waters, this scour time will usually be fairly short, that is, from the time of founding of the vessel upon the sea bottom to freeze up. Thus, if the vessel is founded on cohesive material, or if limited scour can be tolerated, scour protection may not be required. Sand berms or submerged frozen blocks can be provided alongside the hull to provide passive resistance or to increase the path of foundation failure.

The exact requirements for foundation treatment and scour protection will depend on the local sea bed conditions and depth of water specific to each site. Geotechnical investigations of the proposed site should be carried out in advance in order to prepare a proper design for foundation treatment and make plans for all necessary materials and equipment.

The V arrangement of two ships as illustrated in FIGS. 17 and 18 has two possible advantages:

(a) It allows a wedge of sand to be placed in a protected area between the two vessels for increased lateral resistance; and (b) It allows the possibility of having the main and emergency drilling wells placed on separate vessels (rather than having two moonpools on one vessel) and thereby provide an alternative safety procedure in the event of blow-out or fire.

Temperature, Precipitation and Visibility

Typical weather summaries generated from stations in the Beaufort Sea area provide the following general data:

(1) Extreme low temperatures occur from December to March inclusive and range from −42° C. to −50° C. Mean daily temperatures during the same months range from −25° C. to −30° C.

(2) Mean wind speeds do not vary greatly throughout the year but tend to be least in February and greatest in September and October.

(3) Fog is worst during June to August with visibility less than 10 km. occurring nearly 20% of the time. Blowing snow occurs about 12% of the time from October to April.

Ice Conditions in the Beaufort Sea

Ice in the Beaufort Sea consists of two main features, the polar pack which is in constant rotational clockwise motion, and the land fast ice which forms in the autumn and breaks up in the early summer.

During a typical summer, the permanent polar pack resides between 200 and 400 km. offshore. In the fall, driven by offshore winds, the polar pack advances to about the edge of the 100 meter sea-bed contour existing to the north of mainland Canada. Simultaneously, in early October, a band of new land fast ice begins to form along the shore. The final width of this land fast ice zone is very much dependent on the sequence of events at freeze-up. The ultimate extent of the land fast ice is related to water depth, with the 20 meter sea-bed contour normally defining the off-shore fast ice limits, which are reached in a series of growth stages by February or March.

Because the land fast ice is stationary while the permanent polar pack is in continuous motion, a winter transition zone exists between the two ice zones. During the fall, the pressure of the polar pack against the thin first year land fast ice causes considerable deformation and the southern boundary of the transition zone consequently becomes marked by an area of heavy ridge activity. The most active area is generally a band between 5 and 10 km. wide, known as the shear zone. To the north, the transition zone continues out to about the 100 meter water depth, but this is extremely variable, and there is no distinct boundary between this zone and the polar pack. Generally, there is a gradual increase in multi-year ice concentration moving north, but this is usually difficult to detect in mid-winter overflights.

As early as March, the polar pack can start to recede, creating a lead between it and the land fast ice. Depending on surface weather, the width of the lead and ice concentrations can vary on a daily basis. Initially the landfast ice remains intact, but as break-up progresses, floes pull away from the outer edge while the Mackenzie River outflow and other rivers erode the inner side. In this manner, the land fast ice is generally breached by late June or early July on the west side of the Mackenzie River Delta and at the Horton River in Franklin Bay. The remaining fast ice breaks out shortly thereafter.

Summer ice concentrations between the 20 and 100 meter water depths can be extremely variable. In good years, virtually open water can exist throughout from early July to late October. In adverse summers, there is no significant clearing until late August, and freeze-up begins in early October.

As can be appreciated, these ice conditions can generate varied and tremendous hazards and pressures for oil exploration activity in the Beaufort Sea. The various aspects of the invention disclosed above should enable mankind to deal with these adverse conditions more effectively and less expensively.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A well drilling and producing unit for forming in a relatively shallow body of water which may be congested with ice and other materials a well drilling and producing facility positioned on the bottom of the body of water, said unit comprising (1) a conventionally designed tanker comprising bow and stern portions longitudinally tapered with respect to the central vertical plane of its hull, normally capable of transporting oil, bulk material, ore material or a combination of the foregoing materials, said tanker being capable of having its hull at least partially submerged to rest on the bottom of the body of water and being of a strength sufficient to provide stability for well drilling and producing operations and resistance against damage due to ice and other materials that may be present in the body of water, said tanker having been modified to provide an enclosed cavity means extending vertically downwardly completely through the tanker, (2) means on the tanker for taking on moveable ballast for sinking at least a portion of the hull of the tanker onto the bottom of the body of water, and (3) well drilling or producing equipment mounted in operational relationship to the said cavity means.

2. A well drilling and producing unit as called for in claim 1 wherein a compartment is provided in the tanker in fluid communication with the cavity means whereby fluid materials emanating from the drill hole into the cavity means may be directed from the cavity means into the compartment.

3. A well drilling and producing unit as called for in claim 1 wherein a compartment is provided in the tanker in fluid communication with the cavity means and pumping means are provided for pumping fluid from the cavity means into the compartment, whereby fluid materials emanating from the drill hole into the cavity means may be pumped into the compartment.

4. A well drilling and producing unit in accordance with claim 1 wherein means are provided on said tanker to collect solid material from the bottom of the body of water and to distribute such collected material along at least one side of the hull of the tanker to form a barrier of solid material along at least one longitudinally extending side of the hull of the tanker when same is in a partially submerged state.

5. A well drilling and producing unit in accordance with claim 4 wherein said means for collecting and distributing material from the bottom of the body of water comprises a suction line for sucking up through one end the material from the bottom of the body of water, first conveyor means mounted on the deck of the tanker and extending longitudinally along substantially the entire length of the tanker in substantially parallel relationship with the deck of the tanker, said first conveyor means operatively associated at one end with the discharge end of the suction line to receive material sucked up from the bottom of the body of water, means to move said conveyor in a direction away from the discharge end of the suction line, a second conveyor means by which material from the first conveyor means is moved transversely and discharged onto a third conveyor means mounted on the deck of the tanker for substantially the entire length thereof in parallel relationship to and outboard of the first conveyor means, and means to move said third conveyor means in a direction opposite to the direction of said first conveyor means.

6. A well drilling and producing unit in accordance with claim 1 wherein means are provided on the tanker to collect liquid and solid material from the bottom of the body of water and to spray the material onto the body of water along at least one side of the hull of the tanker when same is in a partially submerged state.

7. A method wherein a tanker as called for by claim 1 is at least partially submerged in a relatively shallow body of water by taking on moveable ballast so that it is founded on the bottom of the body of water, a protective barrier is constructed along the side of the hull of the tanker by dredging liquid and solid material from the water body floor and heaping it alongside the hull using dredging mechanism on said tanker, and using the unit in drilling or producing operations.

8. A method wherein a tanker as called for by claim 1 is at least partially submerged in a relatively shallow body of water by taking on moveable ballast so that it is founded on the bottom of the body of water, a protective barrier is constructed along the side of the hull of the tanker by spraying liquid and solid material from the bottom of the body of water onto the surface of ice, using dredging mechanism on said tanker, along at least one side of the hull of the tanker until ice and the sprayed liquid and solid material forms a protective barrier along at least one side of the hull of the tanker, and using the unit in drilling or producing operations.

9. A method in accordance with claim 8 wherein the protective barrier is formed by spraying liquid and solid material from the bottom of the body of water onto the surface of ice until ice and the sprayed liquid and solid material tend to sink to the bottom, allowing ice to re-form on the surface of the water and again spraying liquid and solid material onto the ice until ice and the sprayed liquid and solid material forms a part of the protective barrier.

10. A method wherein at least two tankers as set forth in claim 1 are at least partially submerged in a relatively shallow body of water in a V pattern so that each tanker is founded on the bottom of the body of water, a protective barrier is constructed alongside the tankers in the V shaped area between the tankers by dredging solid material from the bottom of the water body and heaping it in said area using dredging mechanism on at least one of said tankers, placing well drilling or producing equipment in operational relationship to the cavity means of at least one of said tankers and utilizing the vessels as well drilling or producing units.

11. A well drilling and producing unit as called for in claim 1 wherein the hull is divided transversely at one place along its length to form a pair of separable hull sections positioned in side-by-side relationship.

12. A well drilling and producing unit as called for by claim 11 wherein a new bow section is provided for the hull sections so positioned.

13. A well drilling and producing unit as called for by claim 11 wherein a new stern section is provided for the hull sections so positioned.

14. A well drilling and producing unit as called for by claim 11 wherein a new bow section and a new stern section are provided for the hull sections so positioned.

15. A well drilling and producing unit as called for by claim 12 wherein a gunwale height extension is provided extending vertically above the hull sections and the new bow section.

16. A well drilling and producing unit as called for by claim 14 wherein a gunwale height extension is provided extending vertically above the hull sections and the new bow and stern sections.

17. A well drilling and producing unit as called for in claim 1 wherein two conventionally designed tankers are provided, each having a hull which is divided transversely at one place along its length to form a pair of separable hull sections, the said sections of each tanker hull being superposed and the superposed hull sections of each tanker being positioned in side-by-side abutting relationship to the superposed hull sections of the other tanker.

18. A well drilling and producing unit as called for by claim 17 wherein a new bow section is provided for the hull sections.

19. A well drilling and producing unit as called for by claim 17 wherein a new stern section is provided for the two upper hull sections.

20. A well drilling and producing unit as called for by claim 17 wherein a new bow section is provided for the two lower hull sections and a new stern section is provided for the two upper hull sections.

21. A well drilling and producing unit as called for by claim 11 wherein a center connecting piece is provided between the hull sections so positioned.

22. A well drilling and producing unit as called for in claim 1 wherein means are provided mounted on the tanker for propelling the tanker to the place on the body of water where itis to be submerged.

23. A well drilling and producing unit as called for in claim 1 wherein means are provided on the tanker for ejecting moveable ballast from the tanker in order to refloat the tanker.

24. A well drilling and producing unit as called for in claim 1 wherein said unit is positioned on the bottom of a body of water congested with ice in a substantially locked-in state, and barrier material drawn from the said bottom is positioned rising above the level of said bottom and abutting the tanker hull along at least one side of the tanker in a fore and aft direction to resist the pressure of the ice.

25. A well drilling and producing unit in accordance with claim 1 wherein the tanker is positioned on a like tanker in vertical relatiohship therewith and secured thereto with the enclosed cavity means of the two tankers in vertical alignment with each other.

26. A well drilling and producing unit in accordance with claim 1 wherein a second tanker is operatively associated in closely adjacent side-by-side parallel aligned relationship with said tanker.

27. A well drilling and producing unit wherein two vertically arranged tankers in accordance with claim 25 are operatively associated in side-by-side relationship with respect to two other vertically arranged tankers in accordance with claim 26.

28. A method wherein a supporting bed is prepared on the bottom of a relatively shallow body of water, a tanker as called for by claim 1 is floated in said body of water to a position above said bed, the tanker is at least partially submerged by taking on moveable ballast so that it rests on the bottom of the body of water on said bed, and the unit is then ready for use.

29. A method wherein a supporting bed is prepared on the bottom of a relatively shallow body of water, a tanker as called for by claim 23 is floated in said body of water to a position above said bed, the tanker is at least partially submerged by taking on moveable ballast so that it rests on the bottom of the body of water on said bed, the unit is used in drilling or producing operations, and the tanker is refloated by ejecting moveable ballast from the tanker.

30. A method wherein a unit as called for by claim 26 is floated in a relatively shallow body of water and is at least partially submerged by taking on moveable ballast so that it is founded on the bottom of the body of water, a plurality of tankers as defined in claim 1 are arranged to form a protective barrier in a radial pattern about said unit said tankers being at least partially submerged by taking on moveable ballast so that they are founded on the bottom of the body of water, and using the said unit in drilling or producing operations.

31. A method wherein a plurality of tankers as defined in claim 1 are at least partially submerged so that each tanke is founded on the bottom of the water body and the tankers are arranged in side-by-side substantially parallel and abutting relationship and attached together, well drilling or producing equipment is placed in operational relationship to the cavity means of at least one of the tankers, and the structure is utilized as a unitary drilling or producing island.

32. A method wherein a plurality of tankers as defined in claim 1 are arranged one on top of the other with their cavity means in vertical alignment, the tankers being secured together and with the lowermost tanker entirely submerged with its bottom founded on the bottom of the water body and the uppermost tanker is partially submerged, well drilling or producing equipment is placed in operational relationship to the aligned cavity means, and the structure is utilized as a unitary drilling or producing island.

33. A method wherein at least four tankers as defined in claim 1 are arranged in upper and lower pairs of tankers, the tankers of each pair being arranged in side-by-side substantially parallel relationship and attached together, the upper and lower pairs of tankers being interconnected and with their cavity means in vertical alignment, the lower pair of tankers being entirely submerged with the hulls of the tankers founded on the bottom of the water body and the upper pair of tankers is partially submerged, well drilling or producing equipment is placed in operational relationship to at least one pair of the aligned cavity means, and the structure is utilized as a unitary drilling or producing island.

34. A well drilling and producing unit as called for in claim 1 wherein a gunwale height extension to the side of the hull is provided extending vertically above the deck of the tanker and horizontally along at least a portion of the side of the hull of the tanker.

* * * * *